US005535468A

United States Patent [19]

Mallernee

[11] Patent Number: 5,535,468

[45] Date of Patent: Jul. 16, 1996

[54] SAFETY PILLOW ASSEMBLY

[76] Inventor: Wayne B. Mallernee, R.R. #2-3575 Bubbling Brook Rd., Maiden, N.C. 28650

[21] Appl. No.: 526,378

[22] Filed: Sep. 11, 1995

[51] Int. Cl.[6] ..... A47C 20/02

[52] U.S. Cl. ..... 5/638; 5/643

[58] Field of Search ..... 5/636, 638, 643, 5/461, 468, 469

[56] References Cited

U.S. PATENT DOCUMENTS

| | | | |
|---|---|---|---|
| 376,094 | 1/1888 | Hurlburt | 5/636 |
| 2,913,833 | 11/1956 | Glintz | 5/636 |
| 3,616,470 | 11/1971 | Young | 5/638 |
| 4,006,604 | 2/1977 | Seff | 5/638 |
| 4,298,103 | 11/1981 | De Fries | 5/643 |
| 4,606,088 | 8/1986 | Michaelsen | 5/636 |
| 4,731,891 | 3/1988 | Scheurer | 5/636 |

FOREIGN PATENT DOCUMENTS

| | | | |
|---|---|---|---|
| 756251 | 12/1933 | France | 5/636 |
| 1139357 | 1/1969 | United Kingdom | 5/636 |
| 1420221 | 1/1976 | United Kingdom | 5/638 |

*Primary Examiner*—Flemming Saether
*Attorney, Agent, or Firm*—W. Thad Adams, III

[57] ABSTRACT

A safety pillow assembly is provided for use by an infant to prevent suffocation of the infant when lying in a face down position thereon. The pillow assembly includes a hollow, rigid core having spaced-apart top and bottom walls defining an air reservoir. A multiplicity of openings are formed in the core for allowing substantially unobstructed passage of air into and out of the reservoir. An air-permeable, cushioning sleeve encloses the core and provides a soft comfortable surface to cushion the head of the infant. The sleeve allows a free flow of air from the reservoir through the openings in the core and to the infant when lying in a face down position.

9 Claims, 3 Drawing Sheets

SAFETY PILLOW ASSEMBLY

TECHNICAL FIELD AND BACKGROUND OF THE INVENTION

This invention relates to a safety pillow assembly. The invention is especially applicable for use by infants to prevent crib death, or suffocation of the infant when lying in a face down position on a pillow for an extended period of time. The invention is relatively inexpensive to manufacture, and easy to assemble. Moreover, the component parts are separately washable and replaceable.

Conventional pillows are typically formed of a relatively thick and soft material which becomes increasingly more dense and impervious to air when compressed by the weight of an infant's head. Because of the relative immobility of the infant, a potentially fatal condition arises with the infant positioned face down on the pillow. Suffocation of the infant can occur within a matter of minutes. To help prevent this occurrence, there exists is a present need for a safety pillow assembly which is substantially air-permeable, and which provides a reservoir of air to the infant when lying face down on the pillow assembly.

SUMMARY OF THE INVENTION

Therefore, it is an object of the invention to provide a safety pillow assembly for use by infants to guard against suffocation of the infant when lying in a face down position on the pillow assembly.

It is another object of the invention to provide a safety pillow assembly which is soft and comfortable.

It is another object of the invention to provide a safety pillow assembly which includes air-permeable components for allowing relatively free passage of air through the pillow assembly.

It is another object of the invention to provide a safety pillow assembly which includes separately washable and launderable components.

It is another object of the invention to provide a safety pillow assembly which is relatively inexpensive to manufacture.

It is another object of the invention to provide a safety pillow assembly which is relatively easy to assemble and disassemble.

It is another object of the invention to provide a safety pillow assembly which remains generally stationary during use.

It is another object of the invention to provide a safety pillow assembly which includes a rigid hollow core for supplying a reservoir of air to the infant through the walls of the core when lying in a face down position on the pillow assembly.

It is another object of the invention to provide a safety pillow assembly which includes a rigid hollow core which will not collapse during use.

It is another object of the invention to provide a safety pillow assembly made in relatively large dimensions sufficient for use by an infant as an air-permeable safety mattress.

These and other objects of the present invention are achieved in the preferred embodiments disclosed below by providing a safety pillow assembly for use by an infant to prevent suffocation of the infant when lying in a face down position thereon. The pillow assembly includes a hollow, rigid core having spaced-apart top and bottom walls defining an air reservoir. A multiplicity of openings are formed in the core for allowing substantially unobstructed passage of air into and out of the reservoir. An air-permeable, cushioning sleeve encloses the core and provides a soft comfortable surface to cushion the head of the infant. The sleeve allows a free flow of air from the reservoir through the openings in the core and to the infant when lying in a face down position.

According to one preferred embodiment of the invention, the top wall of the core is convex to discourage prolonged face down positioning of the infant's head on the pillow assembly.

According to another preferred embodiment of the invention, the bottom wall of the core is relatively flat for stabilizing the pillow assembly on a supporting surface.

According to yet another preferred embodiment of the invention, the core is formed of a rigid plastic material.

According to yet another preferred embodiment of the invention, the core includes a vertical spacer located between the top and bottom walls thereof for maintaining the top and bottom walls in vertically spaced relation to each other during use of the pillow assembly.

Preferably, the cushioning sleeve is formed of an open-cell, porous foam material.

According to one preferred embodiment of the invention, the thickness of the cushioning sleeve is between 2–5 cm.

According to another preferred embodiment of the invention, a removable and launderable, open-mesh fabric outer case is provided for covering the core and sleeve.

Preferably, the outer case is formed of cotton fabric.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
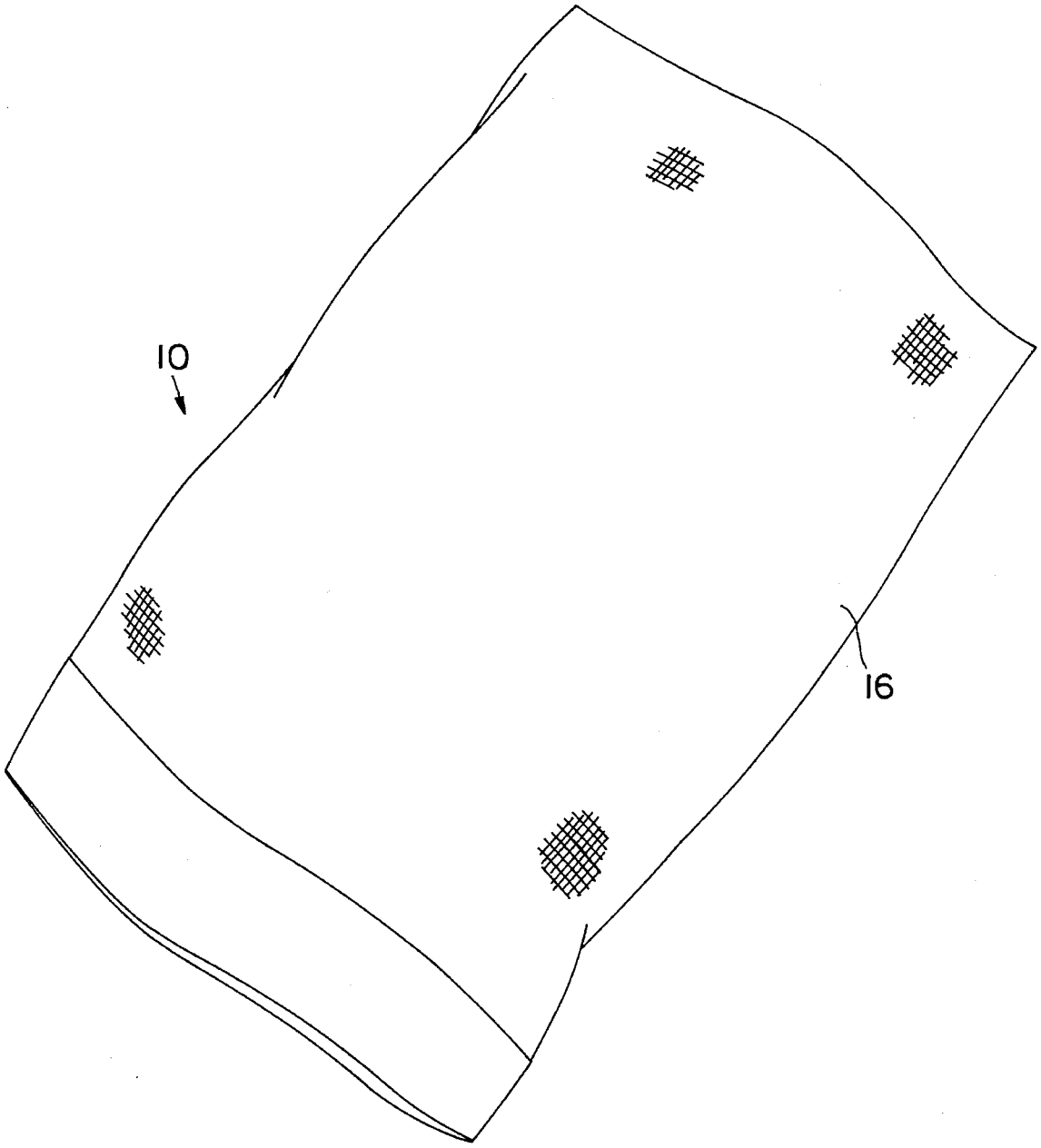
FIG. 1 is a perspective view of the pillow assembly according to one preferred embodiment of the invention.

Referring now specifically to the drawings, a safety pillow assembly according to the present invention is illustrated in FIG. 1 and shown generally at reference numeral 10. The pillow assembly 10 is especially applicable for use by infants to reduce the possibility of suffocation of the infant when lying in a face down position on the pillow assembly 10 by allowing relatively free flow of air through the pillow assembly 10 to the infant.

Figure 2:
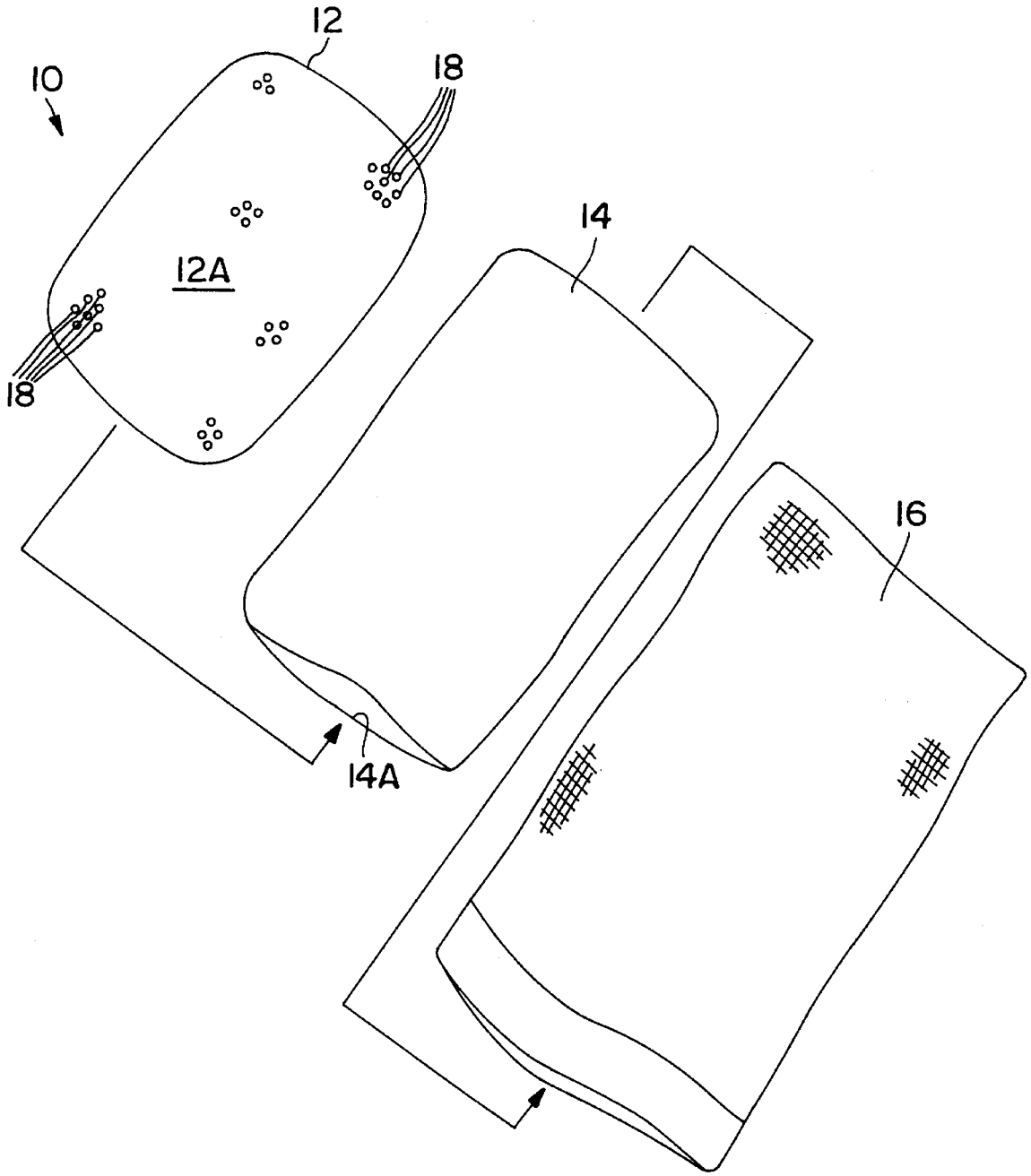
FIG. 2 is a perspective view of the pillow assembly showing the core, sleeve, and case separately.
Figure 3:
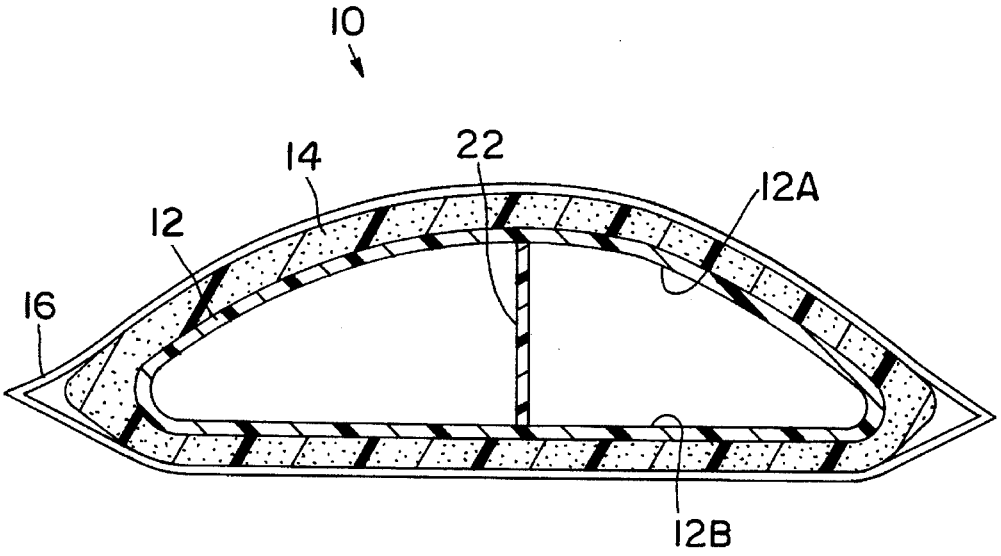
FIG. 3 is a cross-sectional view taken substantially along lines 3—3 of FIG. 1.

As shown in FIGS. 2 and 3, the pillow assembly 10 includes a hollow rigid core 12, a cushioning sleeve 14 enclosing the core 12, and a relatively open-mesh fabric outer case 16 enclosing the sleeve 14 and core 12. The hollow core 12 includes spaced-apart, integrally formed top and bottom walls 12A and 12B, and a multiplicity of openings 18 therein for allowing substantially unobstructed passage of air through the core 12. According to one embodiment, the openings 18 are spaced about 8–10 mm apart, and occupy about 50 percent of the total surface area of the core 12. The diameter of the openings 18 is between 5–10 mm. Preferably, the core 12 is formed of a hard plastic material, such as ABS.

Figure 4:
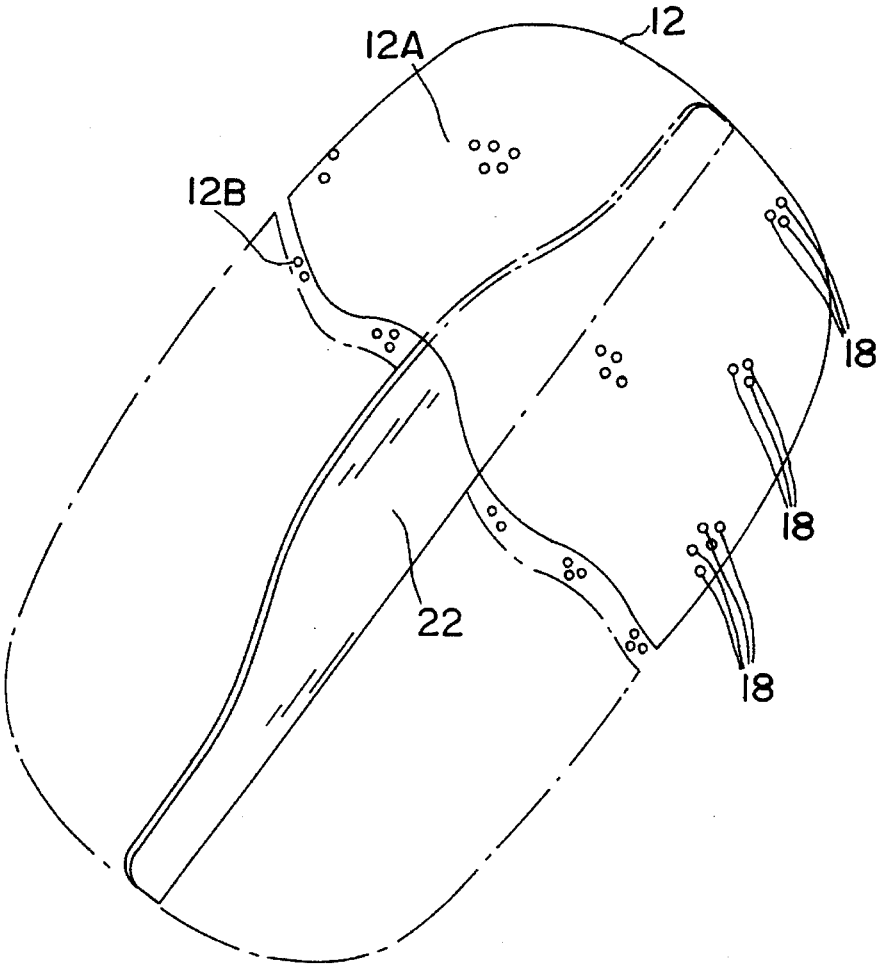
FIG. 4 is an enlarged perspective view of the core with portions broken away and shown in phantom to better illustrate the vertical spacer.

As best shown in FIGS. 3 and 4, the top wall 12A of the core 12 is generally convex, and defines a rounded oval-shaped hump for supporting the head of the infant user. The hump discourages prolonged face down positioning of the head on the pillow assembly 10. The bottom wall 12B of the core 12 is relatively flat to stabilize the pillow assembly 10, and to help prevent movement of the pillow assembly 10 by the infant. According to one embodiment, the width of the core 12 is about 20 cm, the length about 45 cm, and the height at the center point about 7 cm.

A vertical spacer 22 is located between the top and bottom walls 12A and 12B to maintain to the shape of the top wall 12A, and to prevent the core 12 from collapsing during use of the pillow assembly 10. Preferably, the vertical spacer 22 extends the entire length of the core 12, and cooperates with the walls 12A and 12B to define a reservoir of air for being supplied to the infant through the top wall 12A, sleeve 14, and case 16 when lying face down on the pillow assembly 10. In an alternative embodiment (not shown), the width of the core is about 30 cm, and includes two laterally extending vertical spacers located at 10 cm and 20 cm, respectively.

Referring again to FIG. 2, the cushioning sleeve 14 includes at least one open end 14A for receiving the hollow core 12. Preferably, both ends of the sleeve 14 are open to allow enhanced air flow into and through the core 12.

The sleeve 14 is constructed of an air-permeable material, and is between 2–5 cm thick on each side of the core 12. According to one embodiment, the sleeve 14 is formed of an open-cell reticulated foam material, such as that manufactured by Madison Polymeric Engineering of Wallingford, Conn. One suitable foam has a 1.3–1.5 density, 20 porosity per square inch, and 15–25 indentation forced deflection (IFD). Moreover, the cushioning sleeve 14 is readily removable from the core 12 and separately launderable.

According another embodiment, the sleeve 14 is formed of a vacuum bonded, non-woven batt such as that disclosed in U.S. Pat. Nos. 4,753,693 and 5,079,074 issued to Cumulus Fibers, Inc. of Charlotte, N.C. The disclosure of each of these patents is incorporated herein by reference.

The open-mesh fabric outer case 16 of the pillow assembly 10 is slipped over the sleeve 14 and core 12, and provides a soft fabric barrier between the face of the infant and the cushioning material of the sleeve 14. Preferably, the case 16 is formed of cotton, polyester, or a blend of cotton and polyester, and includes about 8–12 openings per square cm. Like the sleeve 14, the case 16 is readily removable from the pillow assembly 10 and separately launderable. Alternatively, a conventional fabric case may be used together with the core 12 and sleeve 14 while providing a lesser degree of air-permeability.

In a further embodiment of the invention, the safety pillow assembly may be made in larger dimensions to provide a cushioned safety mattress for the infant. The hollow core of the safety mattress includes a multiplicity of openings as previously described, and one or more vertical spacers to prevent the core from collapsing under the weight of the infant. Both the top and bottom walls of the core are relatively flat. The sleeve and outer case of the mattress are air-permeable and launderable, and are preferably formed of an identical material described above with reference to the pillow assembly 10.

A safety pillow assembly is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A safety pillow assembly for use by an infant to prevent suffocation of the infant when lying in a face down position thereon, said pillow assembly comprising:

(a) a hollow, rigid core including spaced-apart top and bottom walls defining an air reservoir therebetween, and having a multiplicity of openings therein for allowing substantially unobstructed passage of air into and out of said reservoir;

(b) an interior vertical spacer engaging the top and bottom walls of said core, and extending from one end of said core to the opposite end of said core along a longitudinal dimension thereof for maintaining the top and bottom walls in vertically spaced relation to each other during use of the pillow assembly; and (c) an air-permeable, cushioning sleeve residing adjacent to said core for providing a soft comfortable surface to cushion the head of the infant, and allowing a free flow of air from the reservoir through the openings in the core and to the infant when lying in a face down position.

2. A safety pillow assembly according to claim 1, wherein the top wall of said core is convex to discourage prolonged face down positioning of the infant's head on the pillow assembly.

3. A safety pillow assembly according to claim 1, wherein the bottom wall of said core is relatively flat for stabilizing the pillow assembly on a supporting surface.

4. A safety pillow assembly according to claim 1, where said core is formed of a rigid plastic material.

5. A safety pillow assembly according to claim 1, wherein said cushioning sleeve is formed of an open-cell, porous foam material.

6. A safety pillow assembly according to claim 5, wherein the thickness of said cushioning sleeve is between 2–5 cm.

7. A safety pillow assembly according to claim 1, and including a removable and launderable, open-mesh fabric outer case for covering said core and sleeve.

8. A safety pillow assembly according to claim 7, wherein said outer case comprises fibers chosen from the group consisting of cotton, polyester, and a blend of cotton and polyester.

9. A safety pillow assembly for use by an infant to prevent suffocation of the infant when lying in a face down position thereon, said pillow assembly comprising:

(a) a hollow, rigid core including spaced-apart top and bottom walls defining an air reservoir therebetween, and having a multiplicity of openings therein for allowing substantially unobstructed passage of air into and out of said reservoir;

(b) an interior vertical spacer engaging the top and bottom walls of said core, and extending from one end of said core to the opposite end of said core along a longitudinal dimension thereof for maintaining the top and bottom walls in vertically spaced relation to each other during use of the pillow assembly;

(c) an air-permeable, cushioning sleeve residing adjacent to said core for providing a soft comfortable surface to cushion the head of the infant, and allowing a free flow of air from the reservoir through the openings in the core and to the infant when lying in a face down position;

(d) a removable and launderable, open-mesh fabric outer case for covering said core and sleeve.

* * * * *